US009158244B1

(12) United States Patent
Tatsuura

(10) Patent No.: US 9,158,244 B1
(45) Date of Patent: Oct. 13, 2015

(54) IMAGE FORMING APPARATUS USING A DEVELOPER CONTAINING A NON-VOLATILE OIL

(71) Applicant: FUJI XEROX CO., LTD., Tokyo (JP)

(72) Inventor: Satoshi Tatsuura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/457,603

(22) Filed: Aug. 12, 2014

(30) Foreign Application Priority Data

Mar. 20, 2014 (JP) ..... 2014-058046
Mar. 20, 2014 (JP) ..... 2014-058047

(51) Int. Cl.
*G03G 15/20* (2006.01)
*G03G 15/11* (2006.01)

(52) U.S. Cl.
CPC ..... *G03G 15/2025* (2013.01); *G03G 15/11* (2013.01)

(58) Field of Classification Search
CPC ... G03G 15/10; G03G 15/11; G03G 15/2039; G03G 15/2064
See application file for complete search history.

(56) References Cited

U.S. PATENT DOCUMENTS 6,141,026 A * 10/2000 Domoto et al. ..... 347/140
2014/0242512 A1* 8/2014 Tatsuura et al. ..... 430/112
2014/0287356 A1* 9/2014 Mori et al. ..... 430/114
2014/0321892 A1* 10/2014 Hirayama et al. ..... 399/328
2015/0016852 A1* 1/2015 Katsuta et al. ..... 399/320

FOREIGN PATENT DOCUMENTS

JP A-2003-98864 4/2003
JP A-2003-307995 10/2003

* cited by examiner

*Primary Examiner* — G. M. Hyder
(74) *Attorney, Agent, or Firm* — Oliff PLC

(57) ABSTRACT

An image forming apparatus includes an image forming unit that forms a toner image on a transported medium using a developer containing toner and non-volatile oil, a heating unit that is arranged on a downstream of the image forming unit in a transport direction of the medium and heats the toner image on the medium to a melting temperature of the toner or higher, and a fixing unit that is arranged on a downstream of the heating unit in the transport direction, wherein the fixing unit includes a heat supply section that supplies heat to the developer on the medium, a removal section that removes the non-volatile oil from the developer to which heat is supplied by the heat supply section, and a fixing section that fixes the toner image, which is formed of the developer from which the non-volatile oil is removed by the removal section, on the medium.

7 Claims, 5 Drawing Sheets

FIG. 4

| CONDITIONS/EXAMPLES AND COMPARATIVE EXAMPLES | EXAMPLE 1 | EXAMPLE 2 | COMPARATIVE EXAMPLE 1 | COMPARATIVE EXAMPLE 2 |
|---|---|---|---|---|
| MEDIUM P | COATED PAPER (TOPCOAT 85 g/m$^2$) HIGH-QUALITY PAPER (SHIRAOI 81.4 g/m$^2$) | COATED PAPER (TOPCOAT 85 g/m$^2$) HIGH-QUALITY PAPER (SHIRAOI 81.4 g/m$^2$) | COATED PAPER (TOPCOAT 85 g/m$^2$) HIGH-QUALITY PAPER (SHIRAOI 81.4 g/m$^2$) | COATED PAPER (TOPCOAT 85 g/m$^2$) HIGH-QUALITY PAPER (SHIRAOI 81.4 g/m$^2$) |
| OIL O | KF-96 (DIMETHYL SILICONE OIL, VISCOSITY: 20 cs, MANUFACTURED BY SHIN-ETSU CHEMICAL CO., LTD.) | MORESCO WHITE P40 (LIQUID PARAFFIN, MANUFACTURED BY MORESCO CORPORATION) | KF-96 (DIMETHYL SILICONE OIL, VISCOSITY: 20 cs, MANUFACTURED BY SHIN-ETSU CHEMICAL CO., LTD.) | MORESCO WHITE P40 (LIQUID PARAFFIN, MANUFACTURED BY MORESCO CORPORATION) |
| DENSITY (%) OF TONER T IN LIQUID DEVELOPER | 35 wt% | 35 wt% | 35 wt% | 35 wt% |
| HEATING DEVICE 80 | PROVIDED (HEATED TO 110°C) | PROVIDED (HEATED TO 110°C) | NOT PROVIDED | NOT PROVIDED |

FIG. 5

| TYPE OF MEDIUM P/ EXAMPLES AND COMPARATIVE EXAMPLES | EXAMPLE 1 | EXAMPLE 2 | COMPARATIVE EXAMPLE 1 | COMPARATIVE EXAMPLE 2 |
|---|---|---|---|---|
| COATED PAPER (TOPCOAT 85 g/m$^2$) | 1.1 | 1.5 | 1.6 | 2.1 |
| HIGH-QUALITY PAPER (SHIRAOI 81.4 g/m$^2$) | 1.3 | 1.6 | 2.5 | 2.5 |

IMAGE FORMING APPARATUS USING A DEVELOPER CONTAINING A NON-VOLATILE OIL

CROSS-REFERENCE TO RELATED APPLICATIONS

This application is based on and claims priority under 35 USC 119 from Japanese Patent Application Nos. 2014-058046 and 2014-058047 filed Mar. 20, 2014.

BACKGROUND

Technical Field

The present invention relates to an image forming apparatus.

SUMMARY

According to an aspect of the invention, there is provided an image forming apparatus including:

an image forming unit that forms a toner image on a transported medium using a developer containing toner and non-volatile oil;

a heating unit that is arranged on a downstream of the image forming unit in a transport direction of the medium and heats the toner image on the medium to a melting temperature of the toner or higher; and a fixing unit that is arranged on a downstream of the heating unit in the transport direction, wherein the fixing unit includes a heat supply section that supplies heat to the developer on the medium, a removal section that removes the non-volatile oil from the developer to which heat is supplied by the heat supply section, and a fixing section that fixes the toner image, which is formed of the developer from which the non-volatile oil is removed by the removal section, on the medium.

BRIEF DESCRIPTION OF THE DRAWINGS

Exemplary embodiments of the present invention will be described in detail based on the following figures, wherein:

FIGS. 2A and 2B are diagrams illustrating Embodiment 1, in which FIG. 2A is a schematic diagram illustrating a state of a medium and a toner image immediately after the toner image is formed on the medium by an image forming section, and FIG. 2B is a schematic diagram (cross-sectional view) illustrating the medium and the toner image before the medium is transported to a fixing device;

FIGS. 3A to 3D are diagrams illustrating an exemplary embodiment of the invention, in which FIG. 3A is a schematic diagram (cross-sectional view) illustrating a state of a medium and a toner image immediately after the toner image is formed on the medium by the image forming section and FIGS. 3B to 3D are schematic diagrams (cross-sectional views) illustrating changes in the medium and the toner image observed after toner constituting the toner image on the medium is heated to a melting temperature thereof or higher by a heating device and before the medium is transported to the fixing device;

FIG. 4 is a table illustrating experimental conditions of Examples 1 and 2 and Comparative Examples 1 and 2; and FIG. 5 is a table illustrating experiment results of Examples 1 and 2 and Comparative Examples 1 and 2.

DETAILED DESCRIPTION

Overall Configuration of Image Forming Apparatus

Summary

Hereinafter, an example of an image forming apparatus according to an exemplary embodiment of the invention will be described using FIG. 1. First, the overall configuration and operation of the image forming apparatus will be described. Next, effects of a major component (heating device) according to the exemplary embodiment will be described.

Figure 1:
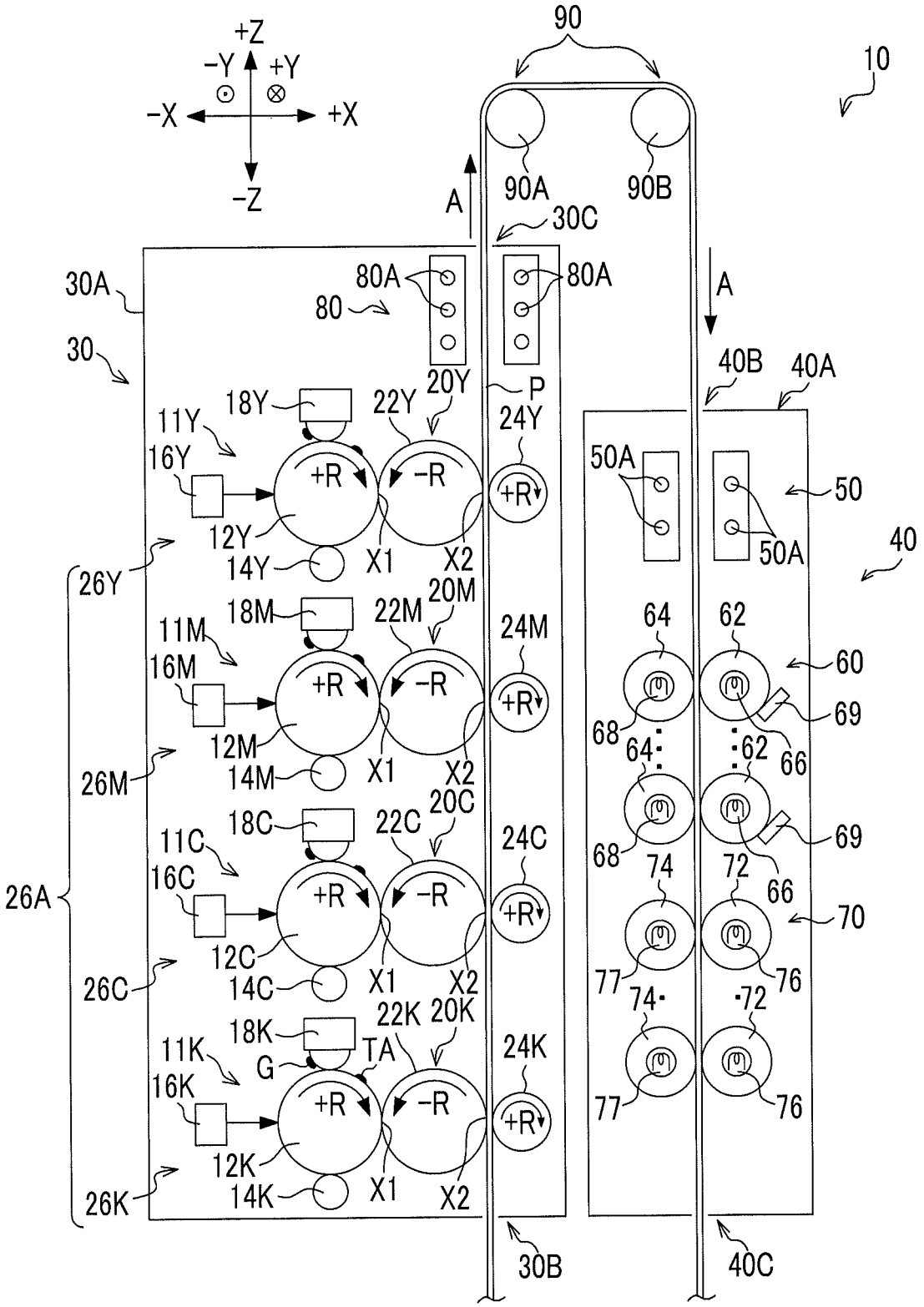
FIG. 1 is a schematic diagram (front view) illustrating an image forming apparatus according to an exemplary embodiment of the invention.

In the following description, a direction indicated by arrow Z in FIG. 1 is a height direction of the apparatus, and a direction indicated by arrow X in FIG. 1 is a width direction of the apparatus. In addition, a direction (indicated by Y) perpendicular to the height and width directions is a depth direction of the apparatus. When the image forming apparatus 10 is seen from the front side, the height direction, the width direction, and the depth direction of the apparatus will be referred to as "Z direction", "X direction", and "Y direction", respectively.

In a case where it is necessary to distinguish one side and the other side of each of the X, Y, and Z directions from each other, when the image forming apparatus 10 is seen from the front, an upper side will be referred to as "+Z side", a lower side will be referred to as "−Z side", a right side will be referred to as "+X side", a left side will be referred to as "−X side", a depth side will be referred to as "+Y side", and a front side will be referred to as "−Y side".

The image forming apparatus 10 includes a transport device 90, an image forming device 30, a fixing device 40, and a controller (not illustrated). The operation of each component of the image forming apparatus 10 is controlled by the controller (not illustrated).

Transport Device

The transport device 90 has a function of transporting a medium P in a direction (transport direction) indicated by arrow A at a predetermined transport speed. The medium P is continuous paper and, for example, is transported from the −Z side to the +Z side on an upstream side of a transport roll 90A in the transport direction and is transported from the +Z side to the −Z side on a downstream side of a transport roll 90B in the transport direction. In addition, the transport rolls 90A and 90B are arranged on a downstream side of the image forming device 30 and on an upstream side of the fixing device 40 in the transport direction of the medium P. The transport speed in the exemplary embodiment is, for example, 60 m/min.

Image Forming Device

The image forming device 30 includes an image forming section 26A, a heating device 80, and a housing 30A. The image forming section 26A includes four image forming sections 26K, 26C, 26M, and 26Y. The image forming section 26A and the heating device 80 are arranged inside the housing 30A. In addition, openings 30B and 30C are formed in the housing 30A, and the medium P which is transported by the transport device 90 is inserted into the opening 30B and is discharged from the opening 30C.

The suffix "K" refers to black, the suffix "C" refers to cyan, the suffix "M" refers to magenta, and the suffix "Y" refers to yellow. In addition, in the image forming device 30, the image forming sections 26K, 26C, 26M, and 26Y corresponding to the respective colors are arranged in order of K, C, M, and Y from an upstream side in the transport direction of the medium P described below. In other words, among the image forming sections 26K, 26C, 26M, and 26Y, the image forming section 26Y is arranged on the most downstream side in the transport direction of the medium P.

Image Forming Section

The image forming sections 26K, 26C, 26M, and 26Y constituting the image forming section 26A have a function of forming a toner image on the medium P, which is transported by the transport device 90, using a developer containing toner T and non-volatile oil O. The image forming sections 26K, 26C, 26M, and 26Y include image forming units 11K, 11C, 11M, and 11Y and transfer devices 20K, 20C, 20M, and 20Y, respectively. In the following description, when it is not necessary to distinguish toner colors (K, C, M, Y) from one another in the image forming sections 26K, 26C, 26M, and 26Y and the respective members included in these image forming sections, the suffixes K, C, M, and Y will be omitted. Here, the image forming section 26A is an example of the image forming unit.

Image Forming Unit

The image forming unit 11 includes a photoreceptor drum 12, a charging device 14, an exposure device 16, and a developing device 18. Charging devices 14K, 14C, 14M, and 14Y, exposure devices 16K, 16C, 16M, and 16Y, and developing devices 18K, 18C, 18M, and 18Y are arranged in the vicinity of photoreceptor drums 12K, 12C, 12M, and 12Y in this order in the +R direction, respectively.

Photoreceptor Drum

The photoreceptor drum 12 has a function of holding the toner image which is developed by the developing device 18. The photoreceptor drum 12 is formed in a cylindrical shape and rotates around its axis (direction (clockwise direction) indicated by arrow +R) by driving means (not illustrated). The photoreceptor drum 12 includes an aluminum substrate and a photosensitive layer (not illustrated) in which an undercoating layer, a charge generation layer, and a charge transport layer are formed in this order on the substrate.

Charging Device

The charging device 14 has a function of charging an outer peripheral surface of the photoreceptor drum 12. The charging device 14 is arranged along the axis direction (Y direction) of the photoreceptor drum 12. In the exemplary embodiment, the charging device 14 is a charging roll.

Exposure Device

The exposure device 16 has a function of forming a latent image on the outer peripheral surface of the photoreceptor drum 12 which is charged by the charging device 14. The exposure device 16 emits exposure light from a light emitting diode array (not illustrated) according to image data received from an image signal processing unit (not illustrated). Irradiation of this exposure light is performed on the outer peripheral surface of the photoreceptor drum 12 charged by the charging device 14 to form the latent image on the outer peripheral surface.

Developing Device

The developing device 18 has a function of developing the latent image, which is formed on the photoreceptor drum 12, using the developer containing the toner T and the non-volatile oil O to form a toner image. The developing device 18 is arranged along the axis direction (Y direction) of the photoreceptor drum 12.

Transfer Device

The transfer device 20 has a function of secondarily transferring the toner image, which is primarily transferred from the photoreceptor drum 12, onto the transported medium P. The transfer device 20 includes an intermediate transfer roll 22 and a backup roll 24.

Intermediate Transfer Roll

The intermediate transfer roll 22 is in contact with the photoreceptor drum 12 and is rotated in a direction indicated by arrow −R (counterclockwise direction) in a primary transfer position X1 which is positioned on an upstream side of the charging device 14 and on a downstream side of the developing device 18 in the rotating direction of the photoreceptor drum 12. As a result, the transfer device 20 primarily transfers the toner image, which is formed on the outer peripheral surface of the photoreceptor drum 12, at the primary transfer position X1 to the intermediate transfer roll 22. A primary transfer voltage (bias voltage) is applied between the photoreceptor drum 12 and the intermediate transfer roll 22 by a power source (not illustrated). In addition, when the toner image is primarily transferred to the intermediate transfer roll 22, the oil O (refer to FIG. 3A) is also transferred to the intermediate transfer roll 22.

Backup Roll

The backup roll 24 is arranged on a side opposite the photoreceptor drum 12 to be opposite the intermediate transfer roll 22. The backup roll 24 forms a nip with the intermediate transfer roll 22 and is rotated in the direction indicated by arrow +R along with the rotation of the intermediate transfer roll 22. Here, a position where the intermediate transfer roll 22 is in contact with the medium P is a secondary transfer position X2, and the toner image which is primarily transferred to the intermediate transfer roll 22 is secondarily transferred at the secondary transfer position X2 to the medium P. A secondary transfer voltage (bias voltage) is applied between the intermediate transfer roll 22 and the backup roll 24. In addition, when the toner image is secondarily transferred to the medium P, the oil O (refer to FIG. 3A) is also transferred to the medium P.

Heating Device

The heating device 80 has a function of heating the toner T constituting the toner image, which is formed on the medium P by the image forming section 26, to a melting temperature of the toner T or higher. When the toner T is heated to the melting temperature of the toner T or higher by the heating device 80, particles of the toner T coalesce to each other (are melted and bonded to each other). The heating device 80 is arranged on a downstream of the image forming section 26Y in the transport direction of the medium P (direction indicated by arrow A). The heating device 80 includes, for example, plural infrared heaters 80A. A first part of plural infrared heaters 80A are arranged in line on one surface side of the medium P. Likewise, the other second part of plural infrared heaters 80A are arranged in line on the other surface side of the medium P. The plural infrared heaters 80A which are arranged on one surface side and the other surface side of the medium P are arranged at positions not to be in contact with the medium P with the medium P interposed between the first part and the second part. In the exemplary embodiment, the distance from the secondary transfer position X2 of the image forming section 26Y in the transport direction of the medium P to an upstream end of the heating device 80 in the transfer direction is, for example, 0.3 m (which is set to be slightly large to avoid interference with the roll). Here, the heating device 80 is an example of the heating unit.

Definition of Melting Temperature of Toner and Measurement Method Thereof

The melting temperature of the toner T is a peak temperature of an endothermic peak (main peak) obtained by the following measurement. The melting temperature of the toner T is measured using a DSC calorimeter (differential scanning calorimeter DSC-7, manufactured by PerkinElmer Co., Ltd.) according to ASTMD 3418-8. Melting temperatures of indium and zinc are used to correct the temperature of a detecting unit of the DSC calorimeter, and heat of fusion of indium is used to correct the amount of heat. The melting temperature of the toner T is measured at a temperature increase rate of 10° C./min by using an aluminum pan and setting an empty pan for a control. In the exemplary embodiment, the melting temperature of the toner T is, for example, 110° C.

Fixing Device

The fixing device 40 includes a heat supply section 50, an oil removal section 60, a fixing section 70, and a housing 40A. The heat supply section 50, the oil removal section 60, and the fixing section 70 are arranged inside the housing 40A. The heat supply section 50, the oil removal section 60, and the fixing section 70 are arranged in a region from an upstream side to a downstream side in the transport direction of the medium P. In addition, openings 40B and 40C are formed in the housing 40A, and the medium P which is discharged from the opening 30C of the image forming device 30 is inserted into the opening 40B and is discharged from the opening 40C. Here, the oil removal section is an example of the removal section.

Heat Supply Section

The heat supply section 50 has a function of supplying heat to the developer on the medium P. In the exemplary embodiment, the heat supply section 50 includes, for example, plural infrared heaters 50A. The plural infrared heaters 50A are arranged not to be in contact with the medium P with the medium P interposed between one part and the other part of the plural infrared heaters 50A. When the heat supply section 50 supplies heat to the developer on the medium P, the toner T constituting the toner image on the medium P is heated to the melting temperature of the toner T or higher.

Oil Removal Section

The oil removal section 60 has a function of removing the oil O on the medium P. The oil removal section 60 includes a metal roll 62, a pressure roll 64, a halogen heater 66, a halogen heater 68, and a collecting blade 69.

The metal roll 62 and the pressure roll 64 are arranged opposite to each other with the medium P interposed therebetween. In addition, the metal roll 62 and the pressure roll 64 are formed in a cylindrical shape, respectively. The halogen heater 66 is arranged inside an inner peripheral surface of the metal roll 62 and has a function of heating the metal roll 62. The halogen heater 68 is arranged inside an inner peripheral surface of the pressure roll 64 and has a function of heating the pressure roll 64. The metal roll 62 has a function of rotating while being in contact with the heated oil O on the transported medium P to transfer a part of the oil O on the medium P to an outer peripheral surface of the metal roll 62. The collecting blade 69 is in contact with the outer peripheral surface of the metal roll 62 and has a function of collecting the oil O transferred to the outer peripheral surface of the metal roll 62.

In FIG. 1, the oil removal section 60 on the most upstream side and the oil removal section 60 on the most downstream side in the transport direction of the medium P are illustrated, and the other four oil removal sections 60 are not illustrated. That is, six oil removal sections 60 in total are arranged along the transport direction of the medium P.

Fixing Section

The fixing section 70 has a function of fixing the toner image, formed on the medium P, on the medium P. The fixing section 70 includes a fixing roll 72, a pressure roll 74, a halogen heater 76, and a halogen heater 77.

The fixing roll 72 and the pressure roll 74 are arranged opposite to each other with the medium P interposed therebetween. The fixing roll 72 and the pressure roll 74 are formed in a cylindrical shape, respectively. The pressure roll 74 has a function of pressing the fixing roll 72 with the medium P interposed between the pressure roll 74 and the fixing roll 72. The halogen heater 76 is arranged inside an inner peripheral surface of the fixing roll 72 and has a function of heating the fixing roll 72. The halogen heater 77 is arranged inside an inner peripheral surface of the pressure roll 74 and has a function of heating the pressure roll 74. When being pressed by the pressure roll 74, the fixing roll 72 is dented and forms a nip with the medium P. The fixing section 70 fixes the toner image, which is formed on the medium P passing through the nip, on the medium P using the fixing roll 72.

In FIG. 1, the fixing section 70 on the most upstream side and the fixing section 70 on the most downstream side in the transport direction of the medium P are illustrated, and the other one fixing section 70 are not illustrated. That is, three fixing sections 70 in total are arranged along the transport direction of the medium P.

Developer

Figure 3A:
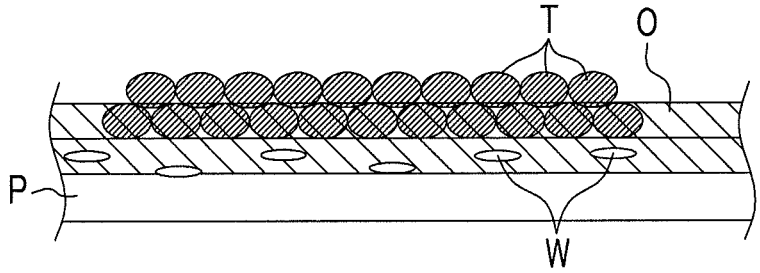

The developer used in the exemplary embodiment is a liquid developer in which the powdered toner T (refer to FIG. 3A) is dispersed in the oil O (refer to FIG. 3A). In the exemplary embodiment, the toner T contains, for example, a polyester resin as a major component. In addition, the oil O contains, for example, dimethyl silicone oil (a type of silicone oil). Here, the dimethyl silicone oil is an example of the non-volatile oil. An average particle size of the toner T is 3 μm to 6 μm, and the toner T cannot infiltrate into the medium P at room temperature. On the other hand, the oil is liquid and thus can infiltrate into the medium P even at room temperature.

Regarding Non-Volatility

Here, non-volatility implies that the amount of volatile matter in oil is 8% by weight or less after the oil is held for 24 hours in an indoor environment in which a flash point thereof is 130° C. or higher or 150° C.

Regarding Difference in Solubility Parameter Value between Toner and Non-Volatile Oil In addition, in the exemplary embodiment, a difference in solubility parameter (SP) value between the toner T and the oil O is from 1.5 to 7.0.

Method of Calculating SP Value

The SP value is a square root of cohesive energy density. In the exemplary embodiment, the SP values of the toner T and the oil O are obtained as follows.

The SP value is obtained using an estimation method of Van Krevelen and Hoftyzer. In this method, on the assumption that the cohesive energy density depends on the type and number of substituents, the SP value of a polymer is calculated in units of segments based on the respective cohesive energy values of the substituents. The cohesive energy calculated in this method is divided by the molar volume of the polymer and a square root is obtained as a SP value (reference: "SP Value Fundamentals, Application, and Calculation method", Hideki Yamamoto, 2005, JOHOKIKO CO., LTD.).

The SP value obtained in this method is, by customary practice, a dimensionless value expressed by a unit of "$cal^{1/2}/cm^{3/2}$. Moreover, in this specification, a relative difference in SP value between two compounds has significance and thus is also expressed as a dimensionless value using values obtained by the above-described customary practice. For reference, when the SP value obtained using this method is expressed in SI units ($J^{1/2}/m^{3/2}$), the SP value needs to be multiplied by 2046.

Other Configurations

Next, configurations of the image forming apparatus 10 other than the above-described configurations will be described.

Regarding Relationship Between Image Forming Device 30 and Fixing Device 40

In the image forming apparatus 10 according to the exemplary embodiment, the image forming device 30 and the fixing device 40 are provided as separate components. The image forming device 30 has a height of, for example, about 3 m. In addition, the fixing device 40 has a height of, for example, about 2.5 m. When the fixing device 40 which is arranged on a downstream side of the image forming device 30 in the transport direction of the medium P is arranged on a further upper side of the image forming device 30, the height of the image forming apparatus 10 is about 5.5 m. Therefore, in the image forming apparatus 10 in which the image forming device 30 and the fixing device 40 are provided as separate components, a transport path of the medium P is bent by the transport device 90 to prevent an increase in the height of the image forming apparatus 10.

In addition, in the image forming apparatus 10 according to the exemplary embodiment, since the image forming device 30 and the fixing device 40 are provided as separate components, in the image forming apparatus 10, the image forming device 30 may be combined with the fixing device 40 which exhibits the optimum performance therefor according to, for example, the transport speed of the medium P. For example, in the image forming apparatus 10 according to the exemplary embodiment, the transport speed of the medium P by the transport device 90 is, for example, 60 m/min. However, in the image forming apparatus 10 according to the exemplary embodiment, when it is desired to further increase the transport speed of the medium P, the image forming device 30 may be combined with the fixing device 40 in which the number of the fixing sections 70 is increased.

Transport Distance of Medium P from Image Forming Device 30 to Fixing Device 40

The transport distance of the medium P from the opening 30C of the image forming device 30 to the opening 40B of the fixing device 40 is, for example, 1.5 m. In addition, the transport speed of the medium P by the transport device 90 is, for example, 60 m/min as described above. Accordingly, the time during which the transport device 90 transports the medium P from the opening 30C to the opening 40B is 1.5 sec.

Image Forming Operation

The image forming apparatus 10 forms an image as follows. In the image forming unit 11K constituting the image forming section 26K, the photoreceptor drum 12K rotates, and the outer peripheral surface of the photoreceptor drum 12K is charged by the charging device 14K. Next, the charged outer peripheral surface of the photoreceptor drum 12K is exposed by the exposure device 16K. As a result, an electrostatic latent image (not illustrated) of a first color (K) is formed on the outer peripheral surface of the photoreceptor drum 12. This electrostatic latent image is developed by the developing device 18K to form a toner image.

The toner image reaches the primary transfer position X1 along with the rotation of the photoreceptor drum 12K and is primarily transferred to the intermediate transfer roll 22K by the primary transfer voltage. At this time, the oil O (refer to FIG. 3A) is also transferred to the intermediate transfer roll 22K along with the toner T. The toner image transferred to the intermediate transfer roll 22K reaches the secondary transfer position X2 along with the rotation of the intermediate transfer roll 22K and is secondarily transferred to the medium P by the secondary transfer voltage. At this time, the oil O is also transferred to the medium P along with the toner T.

Likewise, toner image of a second color (C), a third color (M) and a fourth color (Y) which are formed by the image forming sections 26C, 26M, and 26Y are secondarily transferred to the medium P in order to overlap each other through the intermediate transfer rolls 22C, 22M, and 22Y.

After the toner image is finished being primarily transferred to the intermediate transfer roll 22K, the photoreceptor drum 12K is cleaned by a cleaner (not illustrated) to remove the oil O and the like remaining on the photoreceptor drum 12K. Likewise, the photoreceptor drums 12C, 12M, and 12Y are also cleaned by a cleaner (not illustrated) to remove the oil O and the like. In addition, after the toner image is finished being secondarily transferred to the medium P, the outer peripheral surface of the intermediate transfer roll 22K is cleaned by a cleaner (not illustrated) to remove the oil O and the like remaining on the intermediate transfer roll 22K. Likewise, the intermediate transfer rolls 22C, 22M, and 22Y are also cleaned by a cleaner (not illustrated) to remove the oil O and the like.

In addition, the toner T constituting the toner image which is secondarily transferred to the medium P by the image forming section 26 is heated to the melting temperature of the toner T or higher by the heating device 80. After being heated to the melting temperature of the toner T or higher, the toner T on the medium P is transported to the fixing device 40 along with the medium P.

The medium P on which the toner image is formed is transported to the fixing device 40 by the transport device 90. The medium P and the toner T constituting the toner image on the medium P are heated to the melting temperature of the toner T or higher by the heat supply section 50. Next, a part of the oil O of the toner image on the medium P is removed by the oil removal section 60. Next, the toner image on the medium P from which a part of the oil O is removed is heated and pressed by the fixing section 70 to be fixed on the medium P.

When a monochromatic image is formed on the medium P, for example, when a black (K) image is formed on the medium P, the other image forming units 11C, 11M, and 11Y are retracted from the intermediate transfer rolls 22C, 22M, and 22Y, respectively.

Effects of Major Component (Heating Device)

Next, the effects of the major component (heating device 80) of the exemplary embodiment will be described with reference to the accompanying drawings while compared to the following Embodiments (Embodiments 1 and 2). In the following description, when the same components and the like as those of the exemplary embodiment are used, the components and the like are represented by the same reference numerals.

Comparison to Embodiment 1

An image forming apparatus according to Embodiment 1 does not include the heating device 80. The other points of Embodiment 1 are the same as those of the configurations of the exemplary embodiment.

Figure 2A:
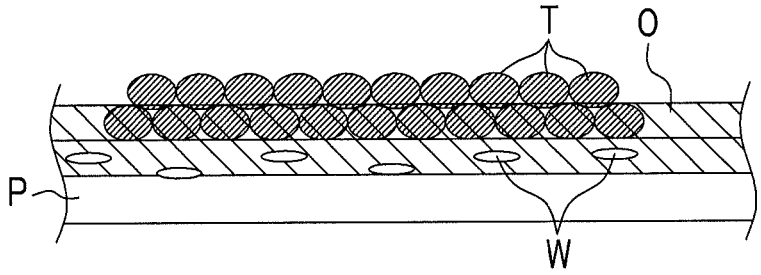

In the image forming apparatus according to Embodiment 1, as illustrated in FIG. 2A, the toner T may not infiltrate into the medium P immediately after the toner image is secondarily transferred from the transfer roll 20 to the medium P. On the other hand, a part of the oil O infiltrates into the medium P immediately after the oil O is transferred to the medium P along with the toner T.

Figure 2B:
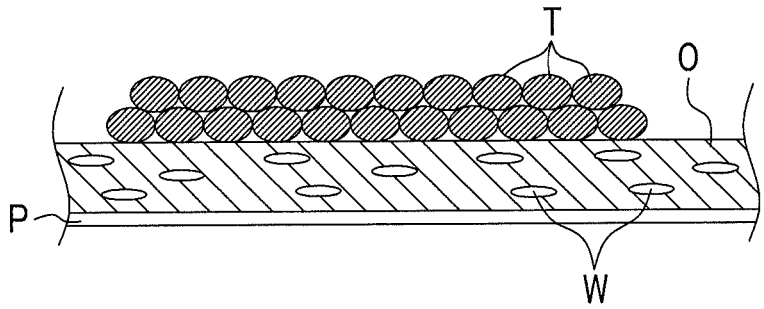

Further, as illustrated in FIG. 2B, the toner T cannot infiltrate into the medium P even after time has elapsed, for example, after the medium P is transported and the toner T constituting the toner image on the medium P reaches the opening 40B of the fixing device 40. On the other hand, substantially all the oil O infiltrates into the medium P. Therefore, the toner T which is secondarily transferred from the transfer roll 20 to the medium P is transported to the fixing device 40 while being attached on the medium P.

In FIGS. 2A and 2B, the symbol W refers to water present in the medium P. In addition, the toner T is attached on the medium P while, for example, about two layers of the toner T are laminated on the medium P. A state where the toner T is solidified is indicated by hatched lines, and a state where the toner T is molten is indicated by dots. The oil O is indicated by hatched lines having an angle and an interval different from those of the toner T.

The same shall be applied to FIGS. 3A to 3D.

Further, when the medium P is transported and the toner T constituting the toner image on the medium P reaches the heat supply section 50 of the fixing device 40, the toner T on the medium P is supplied with heat by the heat supply section 50 such that the temperature thereof is the melting temperature of the toner T or higher. Therefore, particles of the toner T on the medium P start to be melted and coalesce. On the other hand, substantially all the oil O infiltrates into the medium P. Therefore, even when heat is supplied by the heat supply section 50, the oil O having infiltrated into the medium P is not pushed out from the inside of the medium P, and thus an oil layer cannot be formed on the medium P.

Further, even when the medium P is transported and the toner T constituting the toner image on the medium P reaches the oil removal section 60, the oil having infiltrated into the medium P is not removed by the oil removal section 60 because substantially all the oil O infiltrates into the medium P.

Further, when the medium P is transported and the toner T constituting the toner image on the medium P reaches the fixing section 70, the toner T on the medium P is fixed on the medium P to form an image thereon. Substantially all the oil O having infiltrated into the medium P remains in the medium P on which the toner T is fixed.

In Embodiment 1, in the image fixed on the medium P, image strike-through caused by infiltration of the oil O into the medium P occurs. Here, the image strike-through refers to a phenomenon in which, when the image on the medium P is seen from a surface of the medium P opposite to an image-fixed surface, the image is seen through the surface. The image strike-through is a physical amount which changes depending on the thickness of the medium P, the basis weight, the properties of the toner T, and the like. However, in the medium P into which the oil O infiltrates, the degree of the image strike-through increases (the image is likely to be seen through the surface) as compared to the medium P into which the oil O does not infiltrate. In addition, the degree of the image strike-through increases as the amount of the oil O having infiltrated into the medium P increases.

On the other hand, in the image forming apparatus 10 according to the exemplary embodiment, the heating device 80 that heats the toner T on the medium P to the melting temperature of the toner T or higher is arranged on a downstream side of the image forming section 26 and on an upstream side of the fixing device 40 in the transport direction of the medium P. Therefore, in the image forming apparatus 10 according to the exemplary embodiment, the toner T which is secondarily transferred from the transfer roll 20 to the medium P and the oil O which is transferred along with the toner T show different behaviors from those of the image forming apparatus according to Embodiment 1. Hereinafter, these different behaviors will be described with reference to FIGS. 3A to 3D.

Figure 3B:
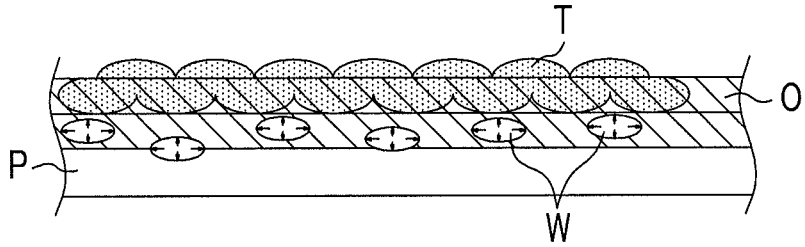
Figure 3C:
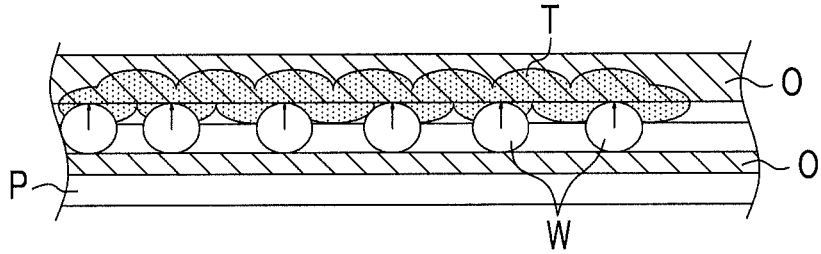
Figure 3D:
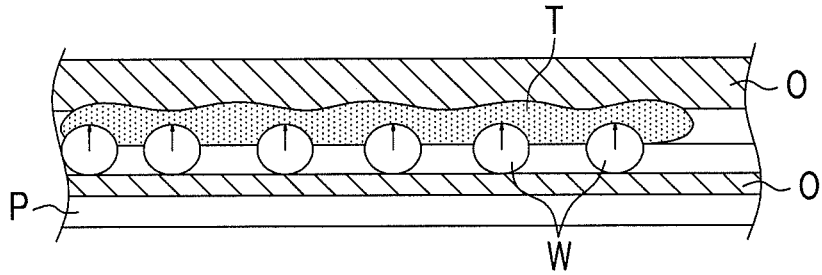

First, as illustrated in FIG. 3A, a part of the oil O transferred to the medium P along with the toner T, which is secondarily transferred from the transfer roll 20 included in the image forming section 26 to the medium P, infiltrates into the medium P. This point is the same as that of the image forming apparatus according to Embodiment 1. However, as illustrated in FIG. 3B, the toner T which is heated to the melting temperature of the toner T or higher by the heating device 80 which heats the toner T on the medium P to the melting temperature of the toner T or higher is changed from the solidified state to the molten state. In addition, as illustrated in FIG. 3B, the water W present in the medium P is heated by the heating device 80 and thus starts to be gasified. Next, as illustrated in FIG. 3C, the toner T and the oil O repel to each other due to a difference between the SP value of the toner T and the SP value of the oil O and thus start to be separated from each other. In addition, since the affinity of the toner T to the medium P is higher than that of the oil O to the medium P, a layer in which the toner T is melted is formed on the medium P as a underlayer, and an oil layer is formed on the layer in which the toner T is melted as an upper layer. The gasified water W has a function of secondarily pushing out the oil O having infiltrated into the medium P from the inside of the medium P. When the medium P reaches the opening 40B of the fixing device 40, as illustrated in FIG. 3D, the toner T is melted on the surface of the medium P to form a layer in which the toner T is melted. In addition, a part of the oil O forms a flat oil layer on the outside of the layer in which the toner T is melted.

Therefore, in the image forming apparatus 10 according to the exemplary embodiment, when the medium P is transported to the fixing device 40, a part of the oil O does not infiltrate into the medium P and is present as a flat oil layer on the outside of the layer in which the toner T is melted. In addition, it is difficult for the oil O forming the flat oil layer to infiltrate into the layer in which the toner T is melted and to infiltrate into the medium P.

When the medium P is transported and the toner T constituting the toner image on the medium P reaches the heat supply section 50 of the fixing device 40, the toner T on the medium P is supplied by the heat supply section 50 with heat such that the temperature thereof is the melting temperature of the toner T or higher. Therefore, particles of the toner T on the medium P start to be melted and coalesce. In addition, the flat oil layer, which is formed on the outside of the layer in which the toner T on the medium P is melted, is supplied with heat by the heat supply section 50.

Further, when the medium P is transported and the toner T constituting the toner image on the medium P reaches the oil removal section 60, the flat oil layer which is supplied with heat by the heat supply section 50 is removed by the oil removal section 60.

Further, when the medium P is transported and the toner T included in the toner image on the medium P reaches the fixing section 70, the toner T on the medium P is fixed on the medium P to form an image thereon. Although a part of the oil O infiltrates into and remains in the medium P, the amount of the oil O of the exemplary embodiment infiltrating into and remaining in the medium P on which the toner T is fixed is less than that of Embodiment 1 infiltrating into and remaining in the medium P on which the toner T is fixed.

Accordingly, according to the image forming apparatus 10 of the exemplary embodiment, image strike-through caused by infiltration of the oil O into the medium P is prevented as compared to the image forming apparatus according to Embodiment 1.

Comparison to Embodiment 2

In an image forming apparatus according to Embodiment 2, different oil is used. Therefore, in the image forming apparatus according to Embodiment 2, a difference in SP value between the toner T and the oil is not in the range from 1.5 to 7.0. The other points of Embodiment 2 are the same as those of the configurations of the exemplary embodiment. Embodiment 2 is included in the technical scope of the invention.

In the image forming apparatus according to Embodiment 2, when the difference in SP value between the toner T and the oil is less than 1.5, the toner T is likely to be dissolved in the oil. Therefore, even when the toner T is heated to the melting temperature or higher by the heating device 80, it is difficult for two layers including the layer in which the toner T is melted and the oil layer to be separately formed on the medium P in this order.

In the image forming apparatus according to Embodiment 2, when the difference in SP value between the toner T and the oil is more than 7.0, the toner T and the oil are likely to be excessively separated from each other. In other words, the dispersibility of the toner T in the oil is likely to be decreased. Therefore, the toner cannot be uniformly dispersed in the oil, and the density of a toner image developed on the photoreceptor drum 12 is likely to be uneven.

On the other hand, in the image forming apparatus 10 according to the exemplary embodiment, a difference in SP value between the toner T and the oil O is from 1.5 to 7.0. Therefore, when the toner T is heated to the melting temperature or higher by the heating device 80, it is easy for two layers including the layer in which the toner T is melted and the oil layer to be separately formed on the medium Pin this order. Accordingly, it is difficult for the oil O forming the oil layer to infiltrate into the layer in which the toner T is melted and to infiltrate into the medium P.

In addition, in the image forming apparatus 10 according to the exemplary embodiment, a difference in SP value between the toner T and the oil O is from 1.5 to 7.0. Therefore, in the developing process by the developing device 18, the dispersibility of the toner T in the oil is within an allowable range, and a toner image in which the density of the toner T is within an allowable range is formed on the photoreceptor drum 12 in the developing process.

Accordingly, according to the image forming apparatus 10 of the exemplary embodiment, image strike-through caused by infiltration of the oil O into the medium P is prevented as compared to the image forming apparatus according to Embodiment 2, and an image in which the image density is within an allowable range can be formed.

In addition, in the image forming apparatus according to Embodiment 2, when the difference in SP value between the toner T and the oil is less than 1.5, the toner T is likely to be dissolved in the oil. In other words, the oil remains in an image (layer in which the toner T is fixed) which is fixed on the medium P. As a result, the image which is fixed on the medium P is likely to be peeled off.

On the other hand, in the image forming apparatus 10 according to the exemplary embodiment, a difference in SP value between the toner T and the oil O is from 1.5 to 7.0. Therefore, in the fixing process by the fixing device 40, since the oil is likely to be separated from gaps between particles of the toner T, the oil O is not likely to remain in the image fixed on the medium P. Accordingly, in the image on the medium P which is formed by the image forming apparatus 10 according to the exemplary embodiment, a bonding strength between the particles of the toner T is higher than that of a case where a difference in SP value between the toner T and the oil is less than 1.5.

Accordingly, according to the image forming apparatus 10 of the exemplary embodiment, an image fixed on the medium P is not likely to be peeled off as compared to the image forming apparatus according to Embodiment 2.

Accordingly, according to the image forming apparatus 10 of the exemplary embodiment, an image in which the image density is within an allowable range can be formed as compared to the image forming apparatus according to Embodiment 2.

In addition, in the image forming apparatus 10 according to the exemplary embodiment, the toner T contains a polyester resin, and the oil O contains silicone oil. Accordingly, according to the image forming apparatus 10 of the exemplary embodiment, an oil layer is likely to be formed on the outside of a layer in which the toner is melted, as compared to an image forming apparatus in which the toner T does not contain a polyester resin, and the oil O does not contain silicone oil.

As described above, the invention has been described in detail using the specific exemplary embodiment. However, the invention is not limited to the above-described exemplary embodiments, and other exemplary embodiments can be adopted within the scope of the invention.

For example, in the exemplary embodiment, the non-volatile oil is silicone oil but may not be silicone oil as long as conditions of the non-volatile oil (for example, a flash point thereof is 130° C. or higher) are satisfied. For example, paraffin-based oil, ether-based oil, plant-based oil, and other oils which satisfy the above-described conditions may also be used. In addition, a mixed oil of plural types of the above-described oils may also be used.

In addition, in the description of the exemplary embodiment, when the heat supply section 50 supplies heat to the developer on the medium P, the toner T on the medium P is heated to the melting temperature of the toner T or higher. However, when the heat supply section 50 supplies heat to the developer on the medium P, for example, the amount of heat which is supplied to the developer on the medium P by the heat supply section 50 may be less than the amount of heat with which the heating device 80 heats the toner T to the melting temperature of the toner or higher. Even in this case, a part of the oil O in the medium P is pushed out to the outer surface of the medium P by the heating device 80, and thus the oil layer is formed on the layer in which the toner T is melted. Therefore, image strike-through by the oil O infiltrating into and remaining in the medium P is prevented. In addition, the power consumption of the heat supply section 50 is reduced.

In addition, in the description of the exemplary embodiment, when the heat supply section 50 supplies heat to the developer on the medium P, the toner T on the medium P is heated to the melting temperature of the toner T or higher. However, when the heat supply section 50 supplies heat to the developer on the medium P, for example, the heat supply section 50 only needs to supply heat to the developer on the medium P such that a part of the toner T constituting the toner image is not removed by being transferred to the fixing section 70. In other words, the heat supply section 50 only needs to supply heat to the developer on the medium P such that the cold-offset or hot-offset of the toner T does not occur in the fixing section 70. Even in this case, a part of the oil O in the medium P is pushed out to the outer surface of the medium P by the heating device 80, and thus the oil layer is formed on the layer in which the toner T is melted. Therefore, image strike-through by the oil O infiltrating into and remaining in the medium P is prevented. In addition, a part of the toner T on the medium P is not likely to be transferred to the fixing section 70 and removed (cold-offset or hot-offset is not likely to occur). Therefore, according to such a modification example, image formation failure caused by the toner T being transferred to the fixing section 70 is prevented. The image formation failure caused by the toner T being transferred to the fixing section 70 refers to a failure that occurs because a toner layer of the toner image on the medium P which is secondarily transferred to the outer surface side is further transferred to the fixing section 70 while the medium P passes through the fixing section 70.

In addition, in the image forming apparatus 10 according to the exemplary embodiment, the heating device 80 is arranged on a downstream side of the image forming section 26Y of the fourth color (Y) in the transport direction of the medium P. However, the heating devices may be arranged between the image forming section 26K and the image forming section 26C, between the image forming section 26C and the image forming section 26M, between the image forming section 26M and the image forming section 26Y, respectively. With such a configuration, the toner T constituting the toner image of each color can be more rapidly heated. Therefore, the infiltration of the oil O into the medium P can also be prevented. In this case, the image forming sections 26K, 26C, and 26M are examples of the image forming unit.

In addition, in the description of the image forming apparatus 10 according to the exemplary embodiment, the image forming operation is performed by one image forming device 30 and one fixing device 40. However, by reversing the medium P after the toner image is fixed on the medium P by the fixing device 40, an image may be formed on both surfaces of the medium P using another image forming device 30 and another fixing device 40.

EXAMPLES

Hereinafter, in Examples, a comparative experiment is performed under conditions of Examples 1 and 2 and Comparative Examples 1 and 2 shown in the table of FIG. 4.

Configuration of Experiment Device

A liquid electrophotographic apparatus MDP 1260 (manufactured by Miyakoshi Co., Ltd.) is modified such that a heating device is provided at a downstream position which is distant by 0.3 m from a transfer nip on the most downstream side of four-color image forming sections in a transport direction of the medium P. In addition, a fixing device is provided at a position distant from the heating device by 1.2 m.

Heating Device and Heating Conditions

In the heating device, three 4 kW infrared heaters and three 4 kW infrared heaters are provided with the medium P interposed therebetween. In the heating device, the toner T can be heated to 110° C. which is the melting temperature of the toner T. As shown in the Table of FIG. 4, in Examples 1 and 2, the toner T is heated to 110° C., which is the melting temperature of the toner T, by the heating device; on the other hand, in Comparative Examples 1 and 2, the toner T is not heated.

Fixing Device and Fixing Conditions

The fixing device includes a heat supply section, an oil removal section, and a fixing section.

In the heat supply section, two 4 kW infrared heaters and two 4 kW infrared heaters are provided with the medium P interposed therebetween. The toner T and the medium P are heated to 110° C.

In the oil removal section, six ϕ80 mm rolls (metal rolls and pressure rolls) and six ϕ80 mm rolls are provided with the medium P interposed therebetween, the rolls are heated to 120° C., and the medium P is pressed at a pressing force of 2.2 kg/cm$^2$.

In the fixing section, three ϕ150 mm rolls (fixing rolls and pressure rolls) and three ϕ150 mm rolls are provided with the medium P interposed therebetween, the rolls are heated to 130° C., and the medium P is pressed at a pressing force of 2.8 kg/cm$^2$.

Experiment Method

In this experiment, as shown in the table of FIG. 4, using mediums P (Example 1 and 2) on which an image is formed when the toner is heated by the heating device and mediums (Comparative Examples 1 and 2) on which an image is formed when the toner is not heated by the heating device, the amount of the oil O infiltrating into and remaining in the medium P after fixing is obtained. In addition, from the viewpoint of strike-through, a range where the amount of the oil O per unit area (1 m$^2$) in the medium P is more than 1.6 g is set as being out of an allowable range. In other words, a range where the amount of the oil O per unit area (1 m$^2$) in the medium P is 1.6 g or less is set as an allowable range. Using liquid developers of CMY, a black solid image formed of three colors of CYM is formed on the entire image-forming region of the medium P.

Procedure of Obtaining Amount of Oil O Infiltrating into and Remaining in Medium P In Example 1, the amount of the oil O infiltrating into and remaining in the medium P is obtained in the following procedure. In the following description, "silicone oil A" refers to silicone oil having a kinetic viscosity of 2.0 mm$^2$/s at a temperature of 25° C. In addition, "silicone oil B" refers to silicone oil having a kinetic viscosity of 20 mm$^2$/s at a temperature of 25° C.

First, the medium P after fixing is cut into a size of 100 mm×100 mm, and the weight thereof is measured. Next, an image sample which is cut into a size of 100 mm×100 mm is dipped in silicone oil A for 1 hour, and silicone oil A is substituted with silicone oil B. Next, the image sample is dried under reduced pressure all day and night such that silicone oil A is completely volatilized. Next, the weight of the image sample is measured, and a difference between this weight and the weight of the image sample which is initially cut into a size of 100 mm×100 mm is obtained as the amount of the oil O infiltrating into and remaining in the medium P.

Since the flash point of silicone oil B is 260° C. or higher, the amount thereof volatilized during all the heating processes (heating processes in the heating device and the heat supply section) is negligible. Therefore, it is considered that the decrease amount Q of the oil O which is transferred to the medium P by the image forming section corresponds to the amount AD of the oil O which is removed by the oil removal section. In addition, the amount Q of the oil O which is transferred to the medium P by the image forming section is obtained from the density of the toner T (the density of the toner T in the liquid developer) and the weight of the toner (TMA) on the transfer roll positioned on the most downstream side of the image forming section in the transport direction of the medium P. In this experiment, the amount Q is 6 g per unit area (1 m$^2$).

In Example 2, the amount of the oil O infiltrating into and remaining in the medium P is obtained with the same method as that of Example 1, except that liquid paraffin (MORESCO WHITE P40, manufactured by Moresco Corporation) is used instead of silicone oil A.

Experiment Result

Examples 1 and 2

In all the mediums of Examples 1 and 2, as shown in the table of FIG. 5, the amount of the oil O per unit area (1 m$^2$) in the medium P is 1.6 or less. That is, in all the mediums of Examples 1 and 2, the amount of the oil O per unit area (1 $m^2$) in the medium P is within the allowable range.

Comparative Examples 1 and 2

On the other hand, in coated paper which is used as a medium in Comparative Examples 1, as shown in the table of FIG. 5, the amount of the oil O per unit area (1 $m^2$) in the medium P is 1.6 g (within the allowable range). However, in high-quality paper, the amount of the oil O per unit area (1 $m^2$) in the medium P is 2.5 g (out of the allowable range).

In addition, in all the mediums of Comparative Example 2, the amount of the oil O per unit area (1 $m^2$) in the medium P is more than 1.6 g which is out of the allowable range.

Review

It is presumed from the results of Examples 1 and 2 that, when the toner T is heated to the melting temperature of the toner T or higher by the heating device after the toner image is formed on the medium P by the image forming section, the toner T is melted, and the infiltration of the oil O into the medium P is prevented. In addition, it is presumed from the results of Examples 1 and 2 that, since the oil layer is formed on the outer surface of the layer in which the toner T is melted, the oil O is removed by the oil removal section.

When Example 2 is compared to Comparative Example 2, the following results are obtained. In the case of coated paper, in Example 2, the amount of the oil O per unit area (1 $m^2$) in the medium P is decreased by about 30% as compared to Comparative Example 2. When comparing Example 2 with Comparative Example 2, in the case of high-quality paper, in Example 2, the amount of the oil O per unit area (1 $m^2$) in the medium P is decreased by about 35% as compared to Comparative Example 2. That is, the following can be seen. Example 2 is different from Example 1 in the type of the oil O, but the configurations of Examples 1 and 2 (configurations in which the toner T is heated to the melting temperature of the toner T or higher by the heating device) are effective although the oil O is changed.

When Example 1 is compared to Example 2, the decrease amount of the oil O in Example 1 in which dimethyl silicone oil is used is less than that of Example 2 in which liquid paraffin oil is used. The following two points are possible reasons therefor. Regarding the first point, a difference (2.1) in SP value between liquid paraffin oil used in Example 2 and the toner T is less than a difference (3.0) in SP value between dimethyl silicone oil used in Example 1 and the toner T. Therefore, it is presumed that, in Example 2, the separation between the toner T and the oil O is insufficient, and the oil removal effect of the oil removal section is low as compared to Example 1. Regarding the second point, the flash point (144° C.) of liquid paraffin oil of Example 2 is lower than the flash point (260° C.) of dimethyl silicone oil of Example 1. Therefore, it is presumed that the amount of the oil O volatilized by the heating unit of Example 2 is more than that of Example 1.

Method of Measuring Various Properties

First, a method of measuring properties of the toner and the like used in Examples and Comparative Examples will be described.

Molecular Weight of Resin

The molecular weight of a resin is measured under the following conditions. As a GPC, "HLC-8120GPC, SC-8020 (manufactured by Tosoh Corporation)" are used. As a column, two columns of "TSKgel, Super HM-H (manufactured by Tosoh Corporation; 6.0 mm ID×15 cm) are used. As an eluent, tetrahydrofuran (THF) is used. The experiment is performed using a refractive index (RI) detector under experimental conditions of a sample density of 0.5%, a flow rate of 0.6 ml/min, a sample injection amount of 10 μl, and a measurement temperature of 40° C. In addition, a calibration curve is prepared from 10 samples, "Polystyrene Standard Sample TSK Standard": "A-500", "F-1", "F-10", "F-80", "F-380", "A-2500", "F-4", "F-40", "F-128", and "F-700" (manufactured by Tosoh Corporation).

Volume Average Particle Sizes of Toner, Resin Particles, Colorant Particles, and the Like The volume average particle sizes of the toner, resin particles, colorant particles, and the like are measured using the following method.

When particle sizes of target particles are 2 μm or more, the particle sizes are measured by using Coulter Multisizer II (manufactured by Beckman Coulter Co., Ltd.) as a measuring device and using ISOTON-II (manufactured by Beckman Coulter Co., Ltd.) as an electrolytic solution.

In this measurement method, from 0.5 mg to 50 mg of a measurement sample is added to a surfactant as a dispersant, preferably, 2 ml of 5% aqueous sodium alkylbenzene sulfonate solution, and this solution is added to from 100 ml to 150 ml of the electrolytic solution. The electrolytic solution in which the measurement sample is suspended is dispersed with an ultrasonic disperser for 1 minute. Then, a particle size distribution of particles having a particle size in a range of 2.0 μm to 60 μm is measured using Multisizer II and an aperture having an aperture size of 100 μm. The number of the target particles is 50,000.

Using the measured particle distribution, volume and number cumulative distributions are drawn on divided particle size ranges (channels) in order from the smallest particle size. A particle size having a cumulative value of 16% by volume is defined as a volume average particle size D16v, and a particle size having a cumulative value of 16% by number is defined as a number average particle size D16p. In addition, a particle size having a cumulative value of 50% by volume is defined as a volume average particle size D50v, a particle size having a cumulative value of 50% by number is defined as a number average particle size D50p, a particle size having a cumulative value of 84% by volume is defined as a volume average particle size D84v, and a particle size having a cumulative value of 84% by number is defined as a number average particle size D84p. The volume average particle size is D50v.

Using the above values, a volume average particle size distribution index (GSDv) is calculated from $(D84v/D16v)^{1/2}$, a number average particle size distribution index (GSDp) is calculated from $(D84p/D16p)^{1/2}$, and a lower number particle size distribution index (lower GSDp) is calculated from {(D50p)/(D16p)}.

On the other hand, when particle sizes of target particles are less than 2 μm, the particle sizes are measured using a laser diffraction particle size distribution analyzer (LA-700, manufactured by Horiba Ltd.). In this measurement method, a dispersion of a sample having a solid content of 2 g is prepared, and ion exchange water is added to the dispersion such that the total amount thereof is 40 ml. This solution is poured into a cell until an appropriate concentration is obtained, and is held for 2 minutes. Once the concentration in the cell is stabilized, the measurement is performed. The obtained volume average particle sizes for the respective channels are accumulated in order from the smallest volume average particle size, and a particle size having a cumulative value of 50% is obtained as a volume average particle size. Glass Transition Temperature and Melting Temperature of Resin A glass transition temperature (Tg) and a melting temperature (Tm) are obtained from respective main peaks measured according to ASTMD 3418-8. The glass transition temperature is a temperature at an intersection between an extended line of the base line and extended line of the rising line in the endothermic portion, and the melting temperature is a peak temperature of the endothermic peak. For the measurement, a differential scanning calorimeter (DSC-7, manufactured by PerkinElmer Co., Ltd.) is used.

Preparation of Toner

Preparation of Amorphous Polyester Resin (1) and Amorphous Resin Particle Dispersion (1a)

| | |
|---|---|
| Polyoxyethylene(2, 0)-2,2-bis(4-hydroxyphenyl) propane | 35 parts by mole |
| Polyoxypropylene(2,2)-2,2-bis(4-hydroxyphenyl)propane | 65 parts by mole |
| Terephthalic acid | 80 parts by mole |
| N-dodecenyl succinic acid | 15 parts by mole |
| Trimellitic acid | 10 parts by mole |

The above-described components and 0.05 part by mole of dibutyltin oxide with respect to the acidic components (terephthalic acid, n-dodecenyl succinic acid, and trimellitic acid) of the above-described components are put into a heated and dried two-necked flask. Nitrogen gas is introduced into the container such that the container is held in an inert atmosphere, and the container is heated, followed by a condensation polymerization reaction at from 150° C. to 230° C. for 12 hours. Next, the pressure is slowly reduced at from 210° C. to 250° C. As a result, an amorphous polyester resin (1) is synthesized.

When the molecular weight (in terms of polystyrene) of the amorphous polyester resin (1) is measured by gel permeation chromatography (GPC), the weight average molecular weight (Mw) thereof is 15,000, and the number average molecular weight (Mn) thereof is 6,800.

In addition, when the amorphous polyester resin (1) is measured using a differential scanning calorimeter (DSC), not a distinct peak but a stepwise change in the endothermic caloric value is shown. The glass transition temperature which is positioned at the intermediate point in the stepwise change in the endothermic caloric value is 62° C.

3,000 parts of the obtained amorphous polyester resin (1), 10,000 parts of ion exchange water, 90 parts of a surfactant, sodium dodecylbenzenesulfonate, are put into an emulsification tank of a high-temperature and high-pressure emulsification device (CAVITRON CD1010, slit: 0.4 mm), are heated and melted at 130° C., are dispersed at 110° C. for 30 minutes at a flow rate of 3 L/m and 10,000 rpm. The obtained solution is allowed to pass through a cooling tank, and an amorphous resin particle dispersion is collected and an amorphous resin particle dispersion (1a) is obtained.

In resin particles included in the obtained amorphous resin particle dispersion (1a), the volume average particle size D50v is 0.3 μm and the standard deviation is 1.2.

Preparation of Crystalline Polyester Resin (2) and Crystalline Resin Particle Dispersion (2a)

| | |
|---|---|
| 1, 4-butanediol (manufactured by Wako Pure Chemical Industries Ltd.) | 293 parts |
| Dodecane dicarboxylic acid (manufactured by Wako Pure Chemical Industries Ltd.) | 750 parts |
| Catalyst (dibutyltin oxide) | 0.3 part |

The above-described components are put into a heated and dried three-necked flask. Nitrogen gas is introduced into the container through a decompression operation such that the container is in an inert atmosphere, followed by mechanical stirring at 180° C. for 2 hours. Next, the solution is slowly heated to 230° C. under reduced pressure, followed by stirring for 5 hours until the solution is viscous. Then, the solution is air-cooled and the reaction is stopped. As a result, a crystalline polyester resin (2) is synthesized.

When the molecular weight (in terms of polystyrene) of the obtained crystalline polyester resin (2) is measured by gel permeation chromatography (GPC), the weight average molecular weight (Mw) thereof is 18,000.

In addition, when the melting temperature (Tm) of the crystalline polyester resin (2) is measured using a differential scanning calorimeter (DSC) with the above-described measurement method, a distinct peak is shown, and a peak temperature is 70° C.

Further, a crystalline resin particle dispersion (2a) is prepared under the same conditions as those of the resin particle dispersion (1a), except that the crystalline polyester resin (2) is used. In particles included in the obtained dispersion, the volume average particle size D50v is 0.25 μm and the standard deviation is 1.3.

Preparation of Colorant Dispersion (1)

| | |
|---|---|
| Phthalocyanine pigment (PVFASTBLUE, manufactured by Dainichiseika Color & Chemicals Co., Ltd. ) | 25 parts |
| Anionic surfactant (NEOGEN RK, manufactured by Daiichi Kogyo Seiyaku Co., Ltd.) | 2 parts |
| Ion exchange water | 125 parts |

The above-described components are mixed and dissolved, followed by dispersing with a homogenizer (Ultra Turrax, manufactured by IKA). As a result, a colorant dispersion (1) is obtained.

Preparation of Release Agent Particle Dispersion (1)

| | |
|---|---|
| Pentaerythritol behenic acid tetraester wax | 100 parts |
| Anionic surfactant (NEWLEX R, NOF Corporation) | 2 parts |
| Ion exchange water | 300 parts |

The above-described components are mixed and dissolved, followed by dispersing with a homogenizer (Ultra Turrax, manufactured by IKA) and dispersing with a pressure discharging homogenizer. As a result, a release agent particle dispersion (1) is obtained.

Preparation of Inorganic Particle Dispersion (1)

| | |
|---|---|
| Hydrophobic silica (RX200, manufactured by Nippon Aerosil Co., Ltd. ) | 100 parts |
| Anionic surfactant (NEWLEX R, NOF Corporation) | 2 parts |
| Ion exchange water | 1000 parts |

The above-described components are mixed and dissolved, followed by dispersing with a homogenizer (Ultra Turrax, manufactured by IKA) and dispersing with a ultrasonic homogenizer (RUS-600CCVP, manufactured by Nissei Corporation) through 200 passes. As a result, an inorganic particle dispersion (1) is obtained.

Preparation of Toner (1)

| | |
|---|---|
| Amorphous resin particle dispersion (1a) | 145 parts |
| Crystalline resin particle dispersion (2a) | 30 parts |
| Colorant dispersion (1) | 42 parts |
| Release agent particle dispersion (1) | 36 parts |

-continued

| | |
|---|---|
| Inorganic particle dispersion (1) | 10 parts |
| Aluminum sulfite (manufactured by Wako Pure Chemical Industries Ltd.) | 0.5 part |
| Ion exchange water | 300 parts |

The above-described components are put into a round stainless steel flask, and the pH of the solution is adjusted to 2.7, followed by dispersing with a homogenizer (Ultra Turrax T50, manufactured by IKA) and heating in a heating oil bath to 45° C. under stirring. The pH of the dispersion is 3.2. After being held at 48° C., the dispersion is appropriately observed using an optical microscope to confirm that aggregated particles having a particle size of 3.8 μm are formed. 1N aqueous sodium hydroxide solution is slowly added to the dispersion to adjust the pH to 8.0, followed by heating to 90° C. under stirring. This state is held for 3 hours. Next, a reaction product is separated by filtration and washed with ion exchange water, followed by drying using a vacuum dryer. As a result, toner particles (1) are obtained.

The volume average particle size D50v of the obtained toner particles (1) is 3.8 μm. 1 part of gas phase silica (R972, manufactured by Nippon Aerosil Co., Ltd.) is mixed by a Henschel mixer and externally added to 100 parts of the toner particles. As a result, toner (1) is obtained.

In Examples 1 and 2 and Comparative Examples 1 and 2, the toner (1) is used as the toner T.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms a toner image on a transported medium using a developer containing toner and non-volatile oil;

a heating unit that is arranged on a downstream of the image forming unit in a transport direction of the medium and heats the toner image on the medium to a melting temperature of the toner or higher; and a fixing unit that is arranged on a downstream of the heating unit in the transport direction, the fixing unit including a heat supply section that supplies heat to the developer on the medium, a removal section that removes the non-volatile oil from the developer to which heat is supplied by the heat supply section, and a fixing section that fixes the toner image, which is formed of the developer from which the non-volatile oil is removed by the removal section, on the medium, and a difference in a solubility parameter (SP) value between the toner and the non-volatile oil contained in the developer being from 1.5 to 7.0.

2. The image forming apparatus according to claim 1, wherein the amount of heat which is supplied to the developer on the medium by the heat supply section is less than the amount of heat with which the heating unit heats the toner to the melting temperature of the toner or higher.

3. The image forming apparatus according to claim 2, wherein the heating unit heats the toner image on the medium such that particles of the toner constituting the toner image on the medium coalesce to each other, and the heat supply section supplies heat to the developer on the medium such that a part of the toner constituting the toner image is not removed by being transferred to the fixing section.

4. The image forming apparatus according to claim 1, wherein the heating unit heats the toner image on the medium such that particles of the toner constituting the toner image on the medium coalesce to each other, and the heat supply section supplies heat to the developer on the medium such that a part of the toner constituting the toner image is not removed by being transferred to the fixing section.

5. The image forming apparatus according to claim 1, wherein the toner contains a polyester resin, and the non-volatile oil contains silicone oil.

6. An image forming apparatus comprising:

an image forming unit that forms a toner image on a transported medium using a developer containing toner and non-volatile oil;

a heating unit that is arranged on a downstream of the image forming unit in a transport direction of the medium and heats the developer on the medium such that particles of the toner contained in the developer on the medium coalesce to each other; and a fixing unit that is arranged on a downstream side of the heating unit in the transport direction, the fixing unit including a removal section that removes the non-volatile oil from the developer heated by the heating unit, a fixing section that fixes the toner image, which is formed of the developer from which the non-volatile oil is removed by the removal section, on the medium, and a heat supply section that is arranged on an upstream side of the removal section in the transport direction and supplies heat to the developer on the medium such that a part of the toner constituting the toner image is not removed by being transferred to the fixing section, and a difference in a solubility parameter (SP) value between the toner and the non-volatile oil contained in the developer being from 1.5 to 7.0.

7. The image forming apparatus according to claim 6, wherein the toner contains a polyester resin, and the non-volatile oil contains silicone oil.

* * * * *